United States Patent [19]

Yamamoto

[11] 4,174,110

[45] Nov. 13, 1979

[54] INERTIA BALANCED GOLF CLUB

[76] Inventor: Zenzo Yamamoto, 2-40-3, Okuzawa, Setagaya-ku, Tokyo, Japan

[21] Appl. No.: 876,707

[22] Filed: Feb. 10, 1978

[30] Foreign Application Priority Data

Apr. 21, 1977 [JP] Japan ..... 52/46252

[51] Int. Cl.[2] ..... A63B 53/04

[52] U.S. Cl. ..... 273/169

[58] Field of Search ..... 273/77 R, 162 R, 163 R, 273/164, 167–171, 193 R, 194 R, 194 A, 73 R, 73 C, 73 J; 124/89

[56] References Cited

U.S. PATENT DOCUMENTS

| | | | |
|---|---|---|---|
| D. 209,294 | 11/1967 | Hitt | 273/164 X |
| 2,652,256 | 9/1953 | Thomas | 273/170 |
| 3,305,235 | 2/1967 | Williams | 273/169 X |
| 3,319,964 | 5/1967 | Steinberg | 273/194 A |
| 3,412,725 | 11/1968 | Hoyt | 124/89 X |
| 3,516,674 | 6/1970 | Scarborough | 273/169 |
| 3,801,099 | 4/1974 | Lair | 273/73 C |
| 3,806,129 | 4/1974 | Burrows | 273/164 |
| 3,873,094 | 3/1975 | Sebo et al. | 273/163 R |

OTHER PUBLICATIONS

"Golf Digest"; May 1972; p. 103.

*Primary Examiner*—Richard J. Apley
*Attorney, Agent, or Firm*—Browdy and Neimark

[57] ABSTRACT

A golf club includes a head which is provided adjacent to its toe and heel with weights which are swingable with respect to the head by the moment of inertia given by the swinging motion of the head and the reaction of a ball struck by the head. Resilient materials connecting the head and weights. This swinging motion of the weights with a delayed motion and in a direction perpendicular to the longitudinal axis of head orient the head at a right angle against an intended course of the ball.

4 Claims, 7 Drawing Figures

INERTIA BALANCED GOLF CLUB

FIELD OF THE INVENTION

This invention relates to golf clubs which can most advantageously prevent a golf ball from curving when it is struck. This invention is particularly effective with a golf club utilized for putting on a putting green.

This invention is described hereinafter in detail with reference to putters, while the invention is employable to other clubs than putters.

BACKGROUND OF THE INVENTION

In order to assure like reaction to a ball by a club head, various attempts have been made in the improvement of golf clubs, particularly putters. One of such attempts is represented by a putter-type golf club disclosed in U.S. Pat. No. 3,873,084, in which a pair of weight balancing members are provided to a toe and heel of the club. These balancing weight are to prevent the club from twisting, by making the moments of inertia of the club about a point at which the ball is struck substantially the same.

SUMMARY OF THE INVENTION

In this invention also, two weights are employed adjacent to a toe and heel of a golf putter. It shall be noted however that the weights employed in the present invention are swingable with respect to the club head, while the aforementioned known weight balancing members are solid with the club head. In other words, the weights in the present invention are inertia ones which operate independently from the head and are consequently more sensitive than the conventional ones. This difference gives with respect to the club head a specific self-alignment characteristic to a ball, as explained hereafter, at the interval of moment before and after the ball is struck and before it is struck off.

DESCRIPTION OF PREFERRED EMBODIMENTS

Numeral 1 indicates a golf ball, 2 a putter head, and 3 a hole.

Figure 1:
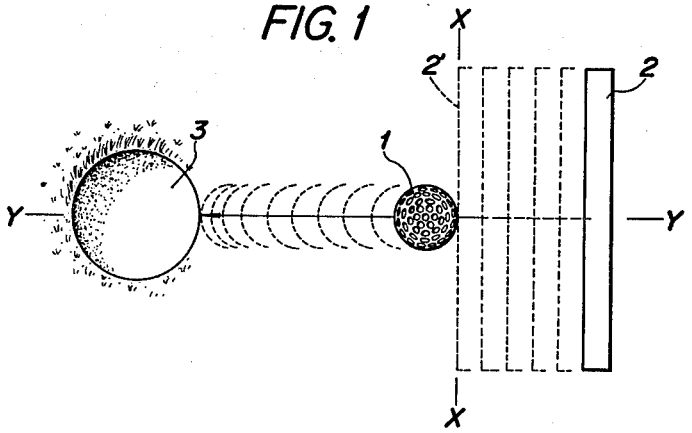
FIG. 1 is an explanatory view showing normal movements of a head of putter and a ball struck by the head.

In FIG. 1, a line connecting the ball 1 and the hole 3 is indicated by the line Y—Y. Provided that a putting green is flat, a successful holing can be always assured, if the ball 1 is struck by the head 2 which has been brought back to a position 2' after addressing it at a right angle to the line Y—Y, viz., the line X—X and swinging it backwards on an extension of the line Y—Y.

Figure 2:
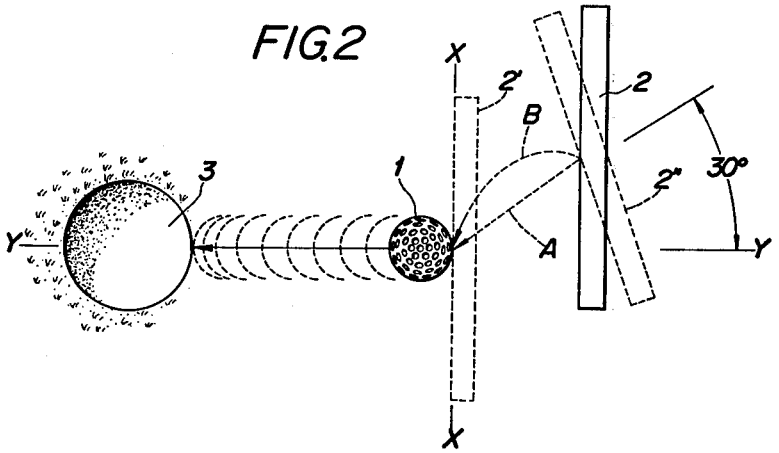
FIG. 2 is a view similar to FIG. 1, in which a putter head moves abnormally before it strikes a ball.

Even in case of FIG. 2 in which a putter head is swung back to a location which is not on the extension of line Y—Y but makes an angle of 30° to said line, a successful hole can be obtained also if the head is finally brought along the line X—X at its percussion with a ball at the position 2'. In this instance, even when the ball 1 is hit by the head 2 which has been swung along an arrow A, it can move straight as illustrated in FIG. 2 so far as the head is brought to the position 2' and so far as the hole 3 is located at a comparatiely short distance, though the ball would make a curve finally, having been spun by the head 2 which was swung in a curve. Hence, it does not matter for moving the ball straight along the line Y—Y whether the striking face of the golf had 2 or 2'' is swung down to the position 2' via the route A or a locus B. But, what is important is to bring about the golf head rightly to the position 2', viz., to bring the striking face of head at a right angle to the intended striking line Y—Y.

Figure 4:
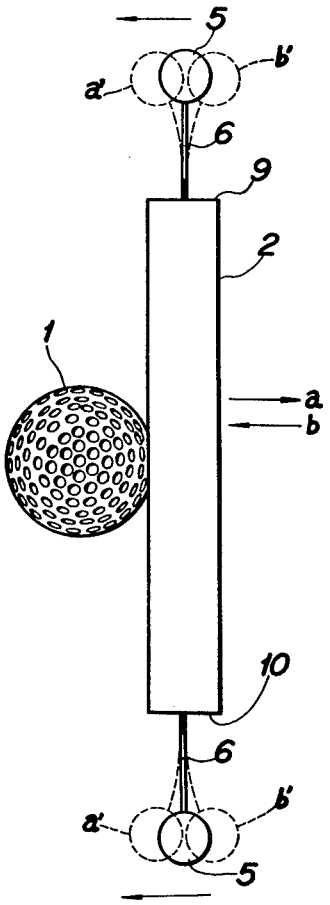
FIG. 4 is further another explanatory view, showing the operation of inertia weights of a putter made in accordance with this invention.

In this connection, it shall be mentioned that the addressing of a golf head at a right angle to the intended striking line Y—Y is a rather easy matter, when a player has exercised by himself. However, it needs certain skill to swing the head back or up from the addressed position to a position exactly behind said addressed position, and to swing forward or down from said position to the addressed position. When the golf head is swung as above-mentioned, the head moves as indicated by arrows a and b in FIG. 4, and consequently weights 5 attached to the golf head adjacent to its toe 9 and heel 10 by means of resilient metal pieces 6 move as indicated by a' and b'. Inertia operating upon the weights 5, 5 gives them such movement which is somewhat slower than the movement of the head. This means that the moment of inertia operated upon the weights is substantially at a right angle to the longitudinal axis of the head. Hence, if the head is addressed at a right angle to the intended striking line Y—Y, the head shall be oriented, on account of the weight 5, to a right angle to the intended striking line Y—Y so far as the head is not swung up and down intentionally out of the line Y—Y.

The direction of moving of a golf ball is further influenced by behaviors of the ball when it is struck by the head.

Figure 3:
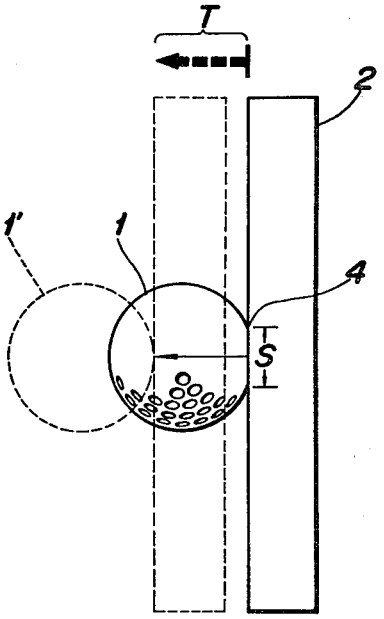
FIG. 3 is another explanatory plan view showing the behavior of a golf ball when it is struck by a head of putter.

As illustrated in FIG. 3, when the ball 1 is striken by the head, it is depressed at its struck surface 4 with a width S. The head 2 continues to move forward , while the ball struck by the head moves faster than the movement of the head, kicking the head by the stricken surface on account of the force of resilient restitution.

At a distance T after the ball is first struck by the head, the ball 1' is released from the head. In other words, the head and the ball are engaged with each other for the distance T, in which the head is always influenced under the percussion force through the reaction of the ball. This percussion force tends to swing the head about the percussion point. In this connection, too, the weights 5 which swing as aforementioned at a right angle to the longitudinal axis of the head, or in parallel with the striking line Y—Y on account of the moment of inertia, can orient the head at a right angle to the striking line Y—Y.

Figure 6:
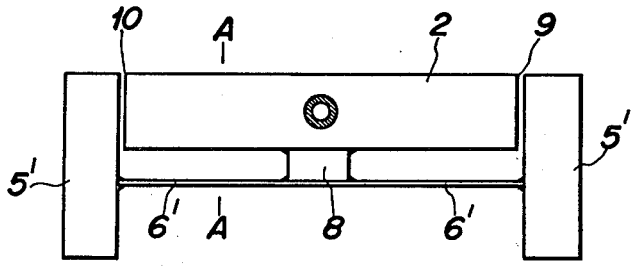
FIG. 6 is another embodiment of a club head made in accordance with this invention.
Figure 5:
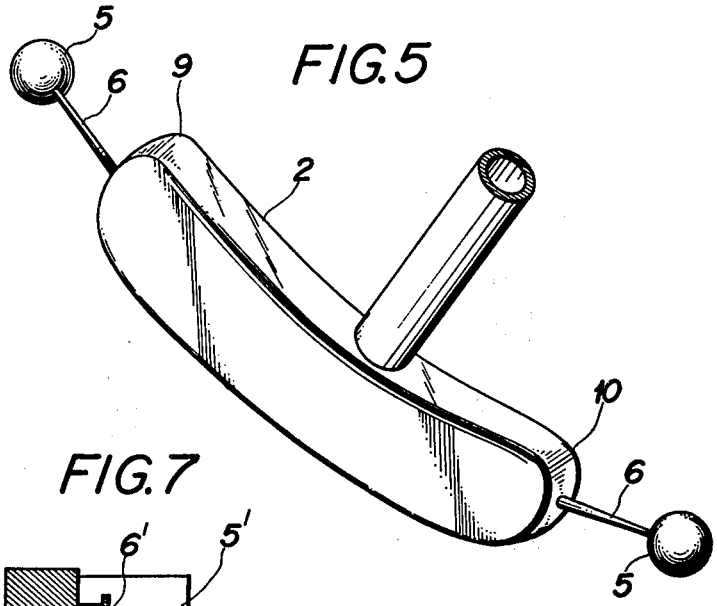
FIG. 5 is a perspective view of the club head illustrated in FIG. 4.
Figure 7:
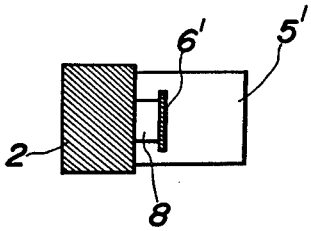
FIG. 7 is a sectional view of FIG. 6, taken along the line A—A thereof.

In FIGS. 6 and 7, there is illustrated another embodiment of a golf club made in accordance with this invention.

The head which is rectangular in its plan view, has in this instance a shorter length between the toe 9 and heel 10, than conventional ones. To a rear face of the head, there is provided a projection 8. A central portion of a strip-like resilient piece 6' which runs in parallel with the longitudinal axis of the head with a distance there between is fixed to the projection 8. Said resilient piece 6' is slightly longer than the length of the head, and has at its both ends weights 5', 5. The weights extend slightly outwardly from the toe 9 and heel 10, and are rectangular and at a right angle with the longitudinal axis of the head. These weights may be used as sighting means.

Though the function of the weights 5' has been described above particularly with reference to FIG. 4, the function is reiterated in the following.

When the head which has been addressed to the position 2' is swung up to the position 2, the weights 5',5 come from a' to b', due to inertia operated thereon, with a more delayed movement than the head on account of resiliency of the pieces 6'. This delayed movement of the weights in parallel with the intended striking line Y—Y works to orient the head which has reached the position 2. The same thing happens when the head is swung down. To wit, the weights 5' move belatedly from the head when it is swung down from the position 2 to the position 2'. This movement orients the head which has been struck by a ball, within the distance T.

What is claimed is:

1. A golf club, comprising:

a head having a striking face;

two weights, respectively disposed with respect to said head adjacent to the toe and heal of the head; and connecting means comprising at least one resilient element, for swingably connecting said weights to said head in such a manner that said weights are independently swingable, with respect to said head when the club is in use, at a right angle to the longitudinal axis of said head in a plane perpendicular to the plane of the striking face of the head.

2. A golf club as claimed in claim 1, wherein said connecting means comprise resilient elements extending outwardly from the toe and heel of said head along the longitudinal axis of said head.

3. A golf club as claimed in claim 1, wherein said connecting means comprises a resilient element connected, between the ends of said resilient element, to the side of said head opposite the striking face thereof and extending parallel to the longitudinal axis of said head, said weights being fixed to the opposite ends of said element.

4. A golf club as claimed in claim 3, wherein said weights are reactangular in shape and extend at a right angle to the longitudinal axis of said head beside the toe and heel of said head with a distance therebetween.

* * * * *